US011287185B1

(12) United States Patent
Jiang

(10) Patent No.: US 11,287,185 B1
(45) Date of Patent: Mar. 29, 2022

(54) FREEZE DRYING WITH CONSTANT-PRESSURE AND CONSTANT-TEMPERATURE PHASES

(71) Applicant: Stay Fresh Technology, LLC, Los Angeles, CA (US)

(72) Inventor: Tonghu Jiang, Los Angeles, CA (US)

(73) Assignee: STAY FRESH TECHNOLOGY, LLC, Los Angeles, CA (US)

( * ) Notice: Subject to any disclaimer, the term of this patent is extended or adjusted under 35 U.S.C. 154(b) by 50 days.

(21) Appl. No.: 17/015,762

(22) Filed: Sep. 9, 2020

(51) Int. Cl.
*F26B 5/06* (2006.01)

(52) U.S. Cl.
CPC ..... *F26B 5/06* (2013.01)

(58) Field of Classification Search
CPC .... F26B 5/00; F26B 5/06; F26B 25/08; F26B 21/12; A23L 3/36
USPC ..... 34/298, 92
See application file for complete search history.

(56) References Cited

U.S. PATENT DOCUMENTS 1,418,638 A * 6/1922 Frankel ..... F26B 5/044 34/92
2,441,021 A * 5/1948 Heineman ..... F26B 5/042 34/92
3,118,742 A * 1/1964 McNair Dalgleish .... F26B 5/06 34/92
3,728,797 A * 4/1973 Worden, Sr. ..... F26B 23/022 34/468
3,949,485 A 4/1976 Fuhring et al.
3,964,174 A 6/1976 King
4,142,303 A * 3/1979 Fraser ..... F26B 5/06 34/92
4,175,334 A 11/1979 Gibert
4,319,408 A 3/1982 Kuboyama
4,449,305 A 5/1984 Baron et al.
4,531,373 A 7/1985 Rubinsky
4,543,735 A 10/1985 Rizvi
4,552,102 A 11/1985 Egle
4,893,415 A 1/1990 Moldrup
5,016,361 A 5/1991 Durr
5,025,571 A 6/1991 Zlobinsky et al.
5,067,251 A 11/1991 Zlobinsky et al.
5,410,788 A 5/1995 Tsuzuki
5,423,109 A 6/1995 Tsuzuki
5,428,884 A 7/1995 Tsuzuki
5,608,974 A 3/1997 Tanaka et al.
5,709,037 A 1/1998 Tanaka et al.
(Continued)

OTHER PUBLICATIONS

John Barley, "Basic Principles of Freeze Drying", https://www.spscientific.com/freeze-drying-lyophilization-basics/. Apr. 2015. pp. 1-16.

(Continued)

*Primary Examiner* — Stephen M Gravini
(74) *Attorney, Agent, or Firm* — Tutunjian & Bitetto, P.C.

(57) ABSTRACT

Freeze-drying methods and systems include performing a constant-pressure drying phase in a chamber, where a temperature of a heating tray increases. A constant-temperature drying phase is performed in the chamber, where a pressure in the chamber decreases. Additional phases alternate between constant-pressure drying phases and constant-temperature drying phases. The alternating drying phases are halted, responsive to a determination that the temperature of the heating tray has reached a maximum temperature.

19 Claims, 7 Drawing Sheets

(56) References Cited

U.S. PATENT DOCUMENTS 5,819,436 A 10/1998 Helevirta
5,937,536 A * 8/1999 Kieselbach ..... F26B 21/004 34/92
6,381,866 B2 5/2002 Gehrmann et al.
6,447,701 B1 9/2002 Heschel et al.
6,487,788 B2 12/2002 Gehrmann et al.
6,610,250 B1 8/2003 Tuma
6,634,118 B2 10/2003 Chen et al.
6,643,950 B2 11/2003 Lambert et al.
6,931,754 B2 8/2005 Sennhenn et al.
6,971,187 B1 * 12/2005 Pikal ..... F26B 5/06 34/285
7,089,681 B2 8/2006 Herbert et al.
7,370,436 B2 5/2008 Auer et al.
7,493,705 B2 2/2009 Gomi
7,972,643 B2 7/2011 Haynes et al.
8,056,256 B2 11/2011 Slack et al.
8,082,681 B2 12/2011 Slack et al.
8,117,005 B2 2/2012 Barresi et al.
8,240,065 B2 8/2012 Rampersad et al.
8,505,212 B2 8/2013 Slack et al.
8,701,307 B2 4/2014 Slack et al.
8,722,749 B2 5/2014 Durance et al.
8,748,396 B2 6/2014 Cesco-Cancian et al.
8,748,397 B2 6/2014 Cesco-Cancian et al.
8,800,162 B2 8/2014 Velardi et al.
8,877,469 B2 11/2014 Durance et al.
8,927,016 B2 1/2015 Shimizu et al.
8,991,067 B2 3/2015 Zielinski et al.
9,046,303 B2 * 6/2015 Yagi ..... F26B 5/06
9,170,049 B2 10/2015 Fissore et al.
9,180,145 B2 11/2015 Brown et al.
9,459,044 B1 10/2016 Haddock et al.
9,513,053 B2 12/2016 Zielinski et al.
9,554,999 B2 1/2017 Cesco-Cancian et al.
9,555,450 B2 1/2017 Hiramoto et al.
9,644,891 B2 5/2017 Zielinski et al.
9,683,780 B2 6/2017 Zielinski et al.
9,746,241 B2 8/2017 Zielinski et al.
9,816,757 B1 11/2017 Zielinski et al.
9,869,513 B2 1/2018 Kuu
9,879,909 B2 1/2018 Fissore et al.
9,970,708 B2 5/2018 Zielinski et al.
10,166,188 B2 1/2019 Genin
10,240,867 B2 3/2019 Zielinski et al.
10,273,168 B2 * 4/2019 Riley ..... B01D 1/24
10,352,615 B2 * 7/2019 Giger ..... A23L 3/363
10,451,346 B1 * 10/2019 Nguyen ..... F26B 5/065
10,485,764 B2 11/2019 Joshi-Hangal et al.
10,519,190 B2 12/2019 Joshi-Hangal et al.
10,533,037 B2 1/2020 Wang et al.
10,566,217 B2 2/2020 Liao et al.
10,653,627 B2 5/2020 Genin
10,966,445 B2 * 4/2021 Butler ..... F26B 21/14
11,185,087 B2 * 11/2021 Nguyen ..... A23F 5/32
2001/0008048 A1 7/2001 Gehrmann et al.
2002/0112361 A1 8/2002 Gehrmann et al.
2002/0121099 A1 9/2002 Lambert et al.
2003/0005597 A1 1/2003 Chen et al.
2003/0182819 A1 10/2003 Michon
2004/0099612 A1 5/2004 Herbert et al.
2004/0237328 A1 12/2004 Auer et al.
2004/0265831 A1 12/2004 Arav et al.
2005/0086830 A1 4/2005 Zukor et al.
2005/0100604 A1 5/2005 Shimizu et al.
2006/0153968 A1 7/2006 Ishihara
2007/0022626 A1 2/2007 Gomi
2008/0050793 A1 2/2008 Durance et al.
2008/0098614 A1 5/2008 Tchessalov et al.
2008/0166385 A1 7/2008 Durance et al.
2009/0107000 A1 4/2009 Octjen
2009/0276179 A1 11/2009 Barresi et al.
2010/0064541 A1 3/2010 Slack et al.
2010/0095504 A1 4/2010 Slack et al.
2010/0107436 A1 5/2010 Velardi et al.
2010/0115787 A1 5/2010 Michon
2011/0068106 A1 3/2011 Zukor et al.
2011/0070311 A1 3/2011 Shimizu et al.
2012/0171462 A1 7/2012 Tsai
2012/0204440 A1 8/2012 Slack et al.
2013/0040370 A1 2/2013 Genin
2013/0081300 A1 4/2013 Gray
2013/0118709 A1 5/2013 Slack et al.
2013/0192083 A1 8/2013 Zielinski et al.
2013/0326899 A1 * 12/2013 Yagi ..... F26B 5/06 34/266
2014/0088025 A1 3/2014 Cesco-Cancian et al.
2014/0088026 A1 3/2014 Cesco-Cancian et al.
2014/0140964 A1 5/2014 Brown et al.
2014/0246056 A1 9/2014 Hiramoto et al.
2014/0259730 A1 9/2014 Zielinski et al.
2015/0168059 A1 6/2015 Zielinski et al.
2015/0192362 A1 7/2015 Zielinski et al.
2015/0297524 A1 10/2015 Cesco-Cancian et al.
2016/0022871 A1 1/2016 Denoziere
2016/0169579 A1 6/2016 Gasteyer et al.
2016/0354948 A1 12/2016 Felty, Jr. et al.
2017/0000738 A1 1/2017 Joshi-Hangal et al.
2017/0082360 A1 3/2017 Zielinski et al.
2017/0098541 A1 4/2017 Gouk et al.
2017/0107264 A1 4/2017 Wang et al.
2017/0205143 A1 7/2017 Zielinski et al.
2018/0066890 A1 3/2018 Zielinski et al.
2018/0086861 A1 3/2018 Grunewald et al.
2018/0292132 A1 10/2018 Zielinski et al.
2018/0306763 A1 10/2018 Brucker et al.
2019/0070117 A1 3/2019 Genin
2019/0085018 A1 3/2019 Joshi-Hangal et al.
2019/0120535 A1 4/2019 Harms et al.
2019/0178576 A1 6/2019 De Beer et al.
2019/0219332 A1 7/2019 Zielinski et al.
2019/0304810 A1 10/2019 Liao et al.
2019/0346328 A1 11/2019 Brucker
2020/0049406 A1 2/2020 Zielinski et al.
2020/0093748 A1 3/2020 Joshi-Hangal et al.
2020/0109896 A1 4/2020 Plitzki et al.
2020/0158431 A1 5/2020 Trout et al.
2020/0172565 A1 6/2020 Joshi-Hangal et al.
2021/0278133 A1 * 9/2021 Parker ..... F26B 21/12
2021/0386100 A1 * 12/2021 Gass ..... A23L 3/44

OTHER PUBLICATIONS

Labconco Corp., "A Guide to Freeze Drying for the Laboratory", https://pim-resources.coleparmer.com/data-sheet/labconco-guide-freeze-dry-in-lab.pdf. Available 2010-2020. pp. 1-12.

* cited by examiner

FREEZE DRYING WITH CONSTANT-PRESSURE AND CONSTANT-TEMPERATURE PHASES

BACKGROUND OF THE INVENTION

The present invention relates to freeze drying, and, more particularly, to freeze drying with alternating periods of constant pressure and constant temperature.

Freeze drying is a process by which water is removed from a substance by sublimation. Whereas evaporation removes liquid water and turns it into a gas, sublimation removes solid ice and converts the ice directly to a gas, without first passing through a liquid phase. This is possible at certain ranges of temperature and pressure, where a sufficiently low pressure allows relatively warm water molecules in ice to escape directly to the surrounding environment, without first melting ice.

Freeze drying can therefore be used to stabilize and preserve certain substances, which might otherwise spoil if kept in a hydrated state. Additionally, the process can be performed quickly, and more completely, relative to drying by evaporation, with less of a risk of contamination or damage to the substance.

BRIEF SUMMARY OF THE INVENTION

A method includes performing a constant-pressure drying phase in a chamber, where a temperature of a heating tray increases. A constant-temperature drying phase is performed in the chamber, where a pressure in the chamber decreases. Additional phases alternate between constant-pressure drying phases and constant-temperature drying phases. The alternating drying phases are halted, responsive to a determination that the temperature of the heating tray has reached a maximum temperature.

A system includes a vacuum chamber and a vacuum pump, configured to evacuate the vacuum chamber. A heating tray is positioned within the vacuum chamber. A controller is configured to control the heating tray to perform a constant-pressure drying phase in a chamber, where a temperature of the heating tray increases, to perform a constant-temperature drying phase in the chamber, where a pressure in the chamber decreases, to alternate between additional constant-pressure drying phases and additional constant-temperature drying phases, and to halt the alternating drying phases responsive to a determination that the temperature of the heating tray has reached a maximum temperature.

A system includes a vacuum chamber and a vacuum pump, configured to evacuate the vacuum chamber. A heating tray is positioned within the vacuum chamber. A temperature sensor is configured to measure a temperature of the heating tray. A pressure sensor is configured to measure a pressure of the vacuum chamber. A controller is configured to control the heating tray to perform a constant-pressure drying phase in a chamber, where the temperature of the heating tray increases, by activating the heating tray to cause a sample sublimation rate to match a combined evacuation rate and condensation rate, to perform a constant-temperature drying phase in the chamber, where pressure in the chamber decreases, by activating the heating tray to compensate for heat loss due to sample sublimation, to alternate between additional constant-pressure drying phases and additional constant-temperature drying phases, to halt the drying phases responsive to a determination that a maximum temperature has been reached, and to perform a final phase, after halting the drying phase, where pressure in the vacuum chamber decreases to a terminal value.

These and other features and advantages will become apparent from the following detailed description of illustrative embodiments thereof, which is to be read in connection with the accompanying drawings.

BRIEF DESCRIPTION OF THE DRAWINGS

The disclosure will provide details in the following description of preferred embodiments with reference to the following figures wherein.

DETAILED DESCRIPTION

Embodiments of the present invention provide methods and systems for freeze drying substances. The present embodiments make use of a drying cycle that includes an iterative process of increasing temperature and decreasing pressure. During periods of increasing temperature, the pressure is held constant, and during periods of decreasing pressure, the temperature is held constant. The present embodiments may control the temperature of a substance, during the freeze drying process, to control the rate of sublimation and, thereby, to control the overall pressure.

Figure 1:
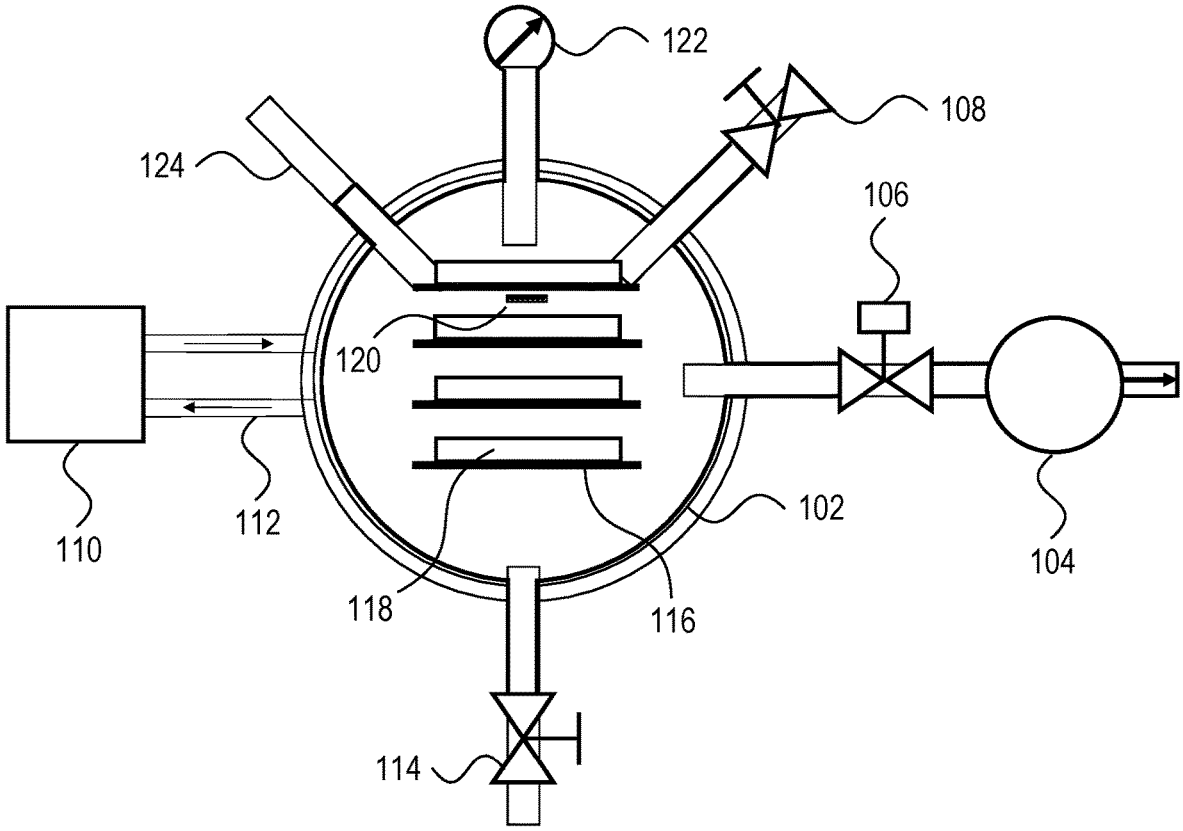
FIG. 1 is a diagram of a freeze drying system that is configured to alternate between constant-pressure and constant-temperature drying phases, in accordance with an embodiment of the present principles.

Referring now to the drawings, in which like numerals represent the same or similar elements, and initially to FIG. 1, an exemplary freeze drying apparatus is shown. A vacuum chamber 102 is shown, with a vacuum pump 104 being controlled by a vacuum valve 106. When the vacuum valve 106 is open, the vacuum pump 104 pumps gases out of the vacuum chamber 102. The vacuum valve 106 may be manually operated, or may be motorized, to control whether the vacuum pump 104 is working on the vacuum chamber 102 at any given time. A vacuum release valve 108 provides an inlet for reintroducing pressure to the vacuum chamber 102, and may similarly be automatically or manually controlled.

A condenser 110 cools a coolant fluid in coolant pipes 112. These coolant pipes 112 run through or around the walls of the vacuum chamber 102, providing a low-temperature inner surface for the vacuum chamber 102. As sublimated water vapor in the vacuum chamber 102 encounters the cold surface of the vacuum chamber 102, the water condenses. During drying, the temperature of the interior face of the vacuum chamber 102 can become quite cold—for example −40° C.—such that the sublimated water vapor forms ice upon condensation. After drying, the ice can melt during a defrosting phase, with the water dripping through drain valve 114.

One or more heating trays 116 are positioned in the vacuum chamber 102, and may hold samples 118. The samples 118 can be formed from any appropriate substance that includes water. The samples 118 are dehydrated through the freeze drying process. The heating trays 116 apply heat to the samples 118 by convection and conduction, and can be controlled to determine how much heat is added. At relatively high pressures, the heat transfer is dominated by convection, while, at low pressures, the heat transfer is dominated by conduction. In some embodiments, the heating trays may have a power output in the range between about 90 W and about 150 W.

In some embodiments, the heating trays 116 have a simple on/off function, with the amount of heat being determined by a duration that the heating trays 116 are turned on. The temperature of the samples 118 can be controlled by controlling the duration and frequency of heating. It is specifically contemplated that the heating trays 116 may include resistive heating elements, which generate heat responsive to a current passing through them. Thus, applying a voltage to the heating trays 116 may put the trays in an "on" state, while turning the voltage off may put the trays in an "off" state.

A temperature sensor 120 provides information regarding the temperature of the samples 118, and may be positioned on, next to, or within one or more of the samples 118. A vacuum sensor pressure 122 measures the pressure within the vacuum chamber 102. The information provided by these sensors can be used, as described in greater detail below, to control the freeze drying process. A cabling inlet 124 may provide for communication between the sensors and an external control system. In some embodiments, the control system may alternatively be positioned within the vacuum chamber 102, or may otherwise be integrated with the vacuum chamber 102.

The present embodiments include multiple distinct modes for controlling the freeze drying process. In a first, mode, each constant temperature cycle and each constant pressure cycle runs for a fixed, predetermined period of time. In a second, threshold-triggered mode, each constant temperature cycle continues until a threshold temperature is reached, and each constant-pressure cycle continues until a pressure threshold is reached. It should be noted that the terms, "constant temperature," and, "constant pressure," may be approximate. In practical embodiments, the "constant temperature" may be obtained by turning heating trays 116 on and off, with a period that is selected to keep the temperature within a predetermined range of a target temperature. Similarly, the "constant pressure" may be obtained by turning the heating trays 116 on and off, thereby managing the sublimation rate to keep the pressure within a predetermined range of a target pressure, for example by compensating for the rate at which water vapor is removed by evacuation by condensation. In some embodiments, the period for controlling the tray may be between about 10 s and about 30 s.

Figure 2:
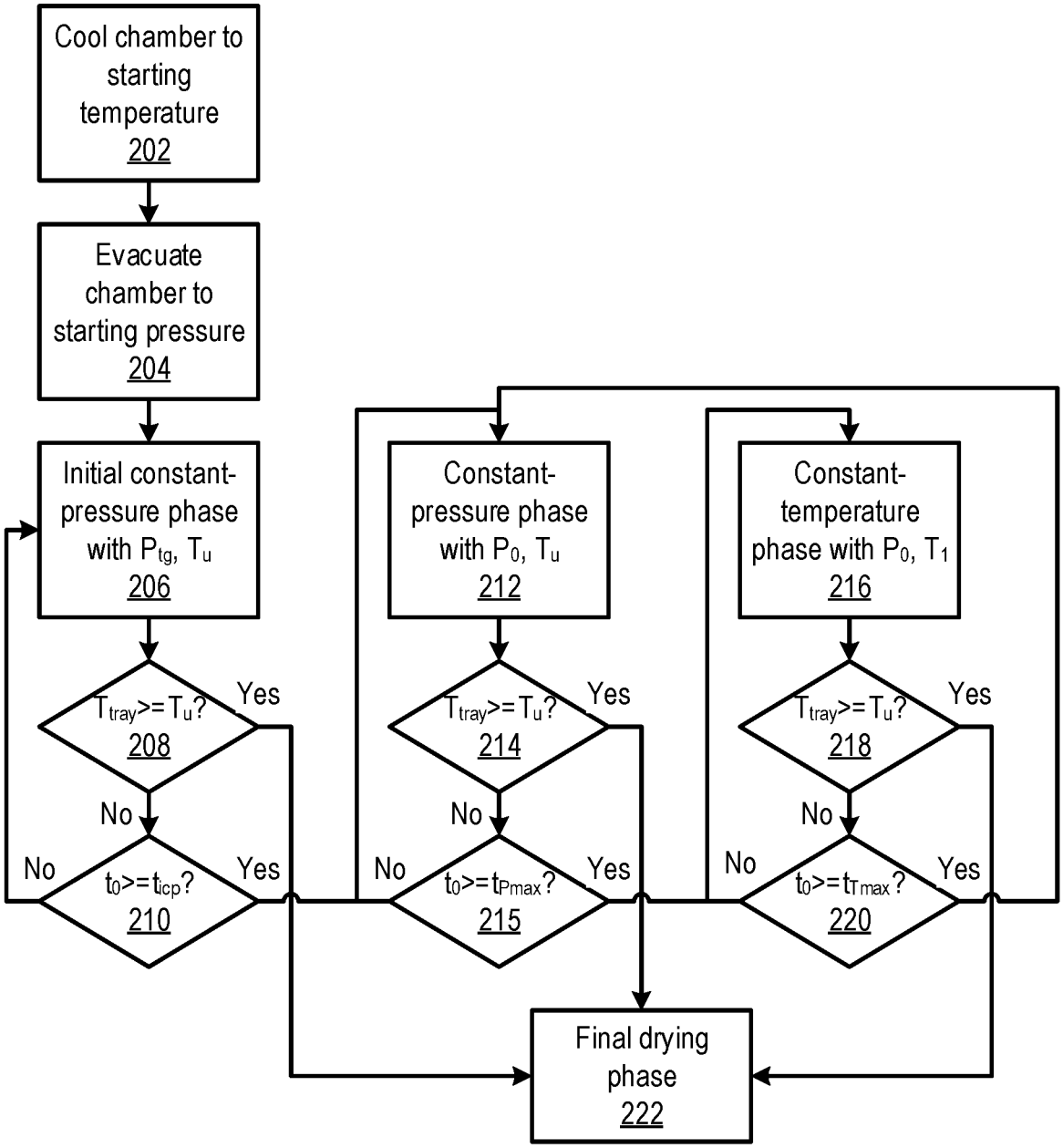
FIG. 2 is a block/flow diagram of a method for freeze-drying a sample using alternating constant-pressure and constant temperature drying phases in a fixed-period mode, in accordance with an embodiment of the present principles.

Referring now to FIG. 2, a method for controlling a freeze drying process in a fixed-period mode is shown. Block 202 begins by cooling the vacuum chamber 102 to a starting temperature, for example about −30° C. This can be performed, for example, by turning on the condenser 110 and waiting for a predetermined time, or waiting until the temperature measured by temperature sensor 120 reaches a predetermined value. Block 204 evacuates the vacuum chamber 102 to a starting pressure, for example below about 60-70 pascal. This can be performed, for example, by turning on the vacuum pump 104 and waiting until the pressure measured by pressure sensor 122 reaches a predetermined value.

Block 206 performs an initial constant-pressure phase, during which the temperature in the vacuum chamber 102 increases, but the pressure is kept roughly constant. The details of the constant-pressure phases and the constant-temperature phases will be described in greater detail below. This phase continues until block 208 determines that the temperature of the tray $T_{tray}$ meets or exceeds a maximum temperature $T_u$, or until block 210 determines that the time of the phase $t_0$ exceeds a maximum initial constant pressure phase time $t_{icp}$, for example between about 15 minutes and about 60 minutes. In some embodiments, the maximum tray temperature $T_u$ may be between about 30° C. and about 60° C., with a specifically contemplated value being about 45° C. $T_u$ is selected to prevent destruction of the sample. For example, if proteins are being freeze dried, and if the proteins denature at 40° C., then the maximum temperature may be set at, or just below, 40° C.

If block 210 finds that $t_{icp}$ has been exceeded, block 212 begins a new constant-pressure phase, with new parameters, including the pressure at the beginning of the phase $P_0$ and the maximum tray temperature $T_u$. During this phase, the temperature increases in the vacuum chamber 102, while the pressure is kept roughly constant. The new constant-pressure phase continues until block 214 determines that the tray temperature $T_{tray}$ has exceeded the maximum tray temperature $T_u$, or until block 215 determines that the time in the new constant-pressure phase has exceeded a maximum constant pressure phase time $t_{Pmax}$, for example between about 15 minutes and about 60 minutes.

If block 215 finds that $t_{Pmax}$ has been exceeded, block 216 beings a new constant-temperature phase, with parameters that include the target pressure from the previous phase $P_0$, and the temperature at the start of the phase, $T_1$. During this phase, the pressure in the vacuum chamber 102 increases, while the temperature is kept roughly constant. The new constant-temperature phase continues until block 218 determines that the tray temperature $T_{tray}$ has exceeded the maximum tray temperature $T_u$, or until block 220 determines that the time in the new constant-temperature phase has exceeded a maximum constant temperature phase time $t_{Tmax}$, for example between about 15 minutes and about 60 minutes.

If block 220 finds that $t_{Tmax}$ has been exceeded, processing returns to block 212 for another new constant-pressure phase, with updated parameters. The constant-pressure phases and constant-temperature phases alternate, until one of block 214 or block 218 breaks the cycle.

If any of blocks 208, 214, or 218 determines that $T_{tray}$ has exceeded the maximum tray temperature $T_u$, then a final drying phase 222 begins, with parameters that include target vacuum pressure $P_{tg}$ and the maximum tray temperature $T_u$. The final drying phase 222 continues until a predetermined condition has been reached. In some embodiments, the condition may include a sensed vacuum pressure that is below a threshold value, for example below a threshold that may be in a range between about 110 microns and about 150 microns, with a specifically contemplated example being 130 microns. At that point, the freeze drying process is complete. The pressure valve 108 may be opened to normalize pressure inside the vacuum chamber 102, and the freeze-dried samples 118 may be removed.

Figure 3:
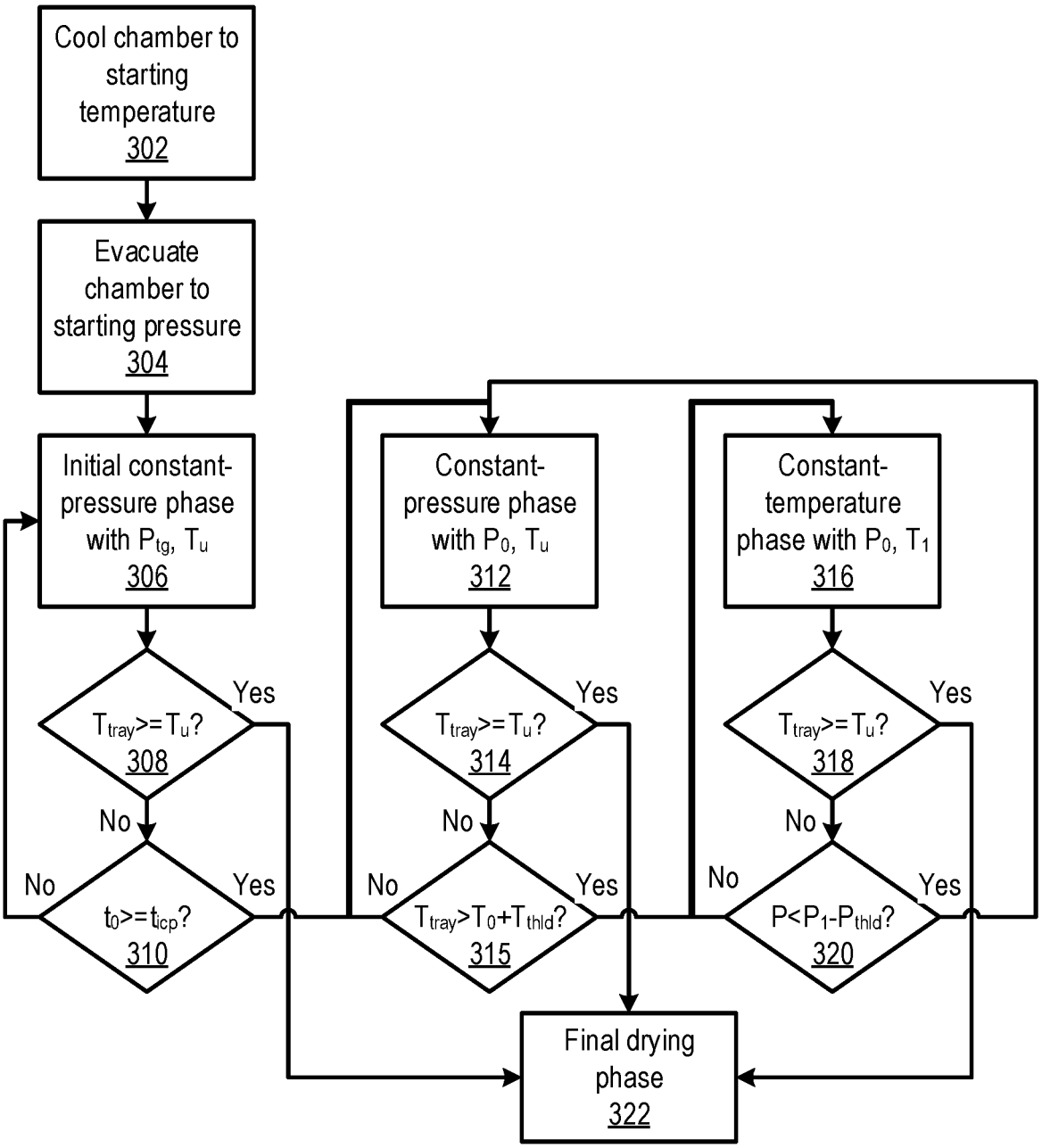
FIG. 3 is a block/flow diagram of a method for freeze-drying a sample using alternating constant pressure and constant temperature drying phases in a threshold-triggered mode, in accordance with an embodiment of the present principles.

Referring now to FIG. 3, a method for controlling a freeze drying process in a threshold-triggered mode is shown. In the threshold-triggered mode, the constant-pressure and constant-temperature phases each continue until their respective measurement (pressure or temperature) has changed by a threshold amount from its value at the beginning of the phase.

As in the fixed-period mode, block 302 begins by cooling the vacuum chamber 102 to a starting temperature. This can be performed, for example, by turning on the condenser 110 and waiting for a predetermined time, or waiting until the temperature measured by temperature sensor 120 reaches a predetermined value. Block 304 evacuates the vacuum chamber 102 to a starting pressure. This can be performed, for example, by turning on the vacuum pump 104 and waiting until the pressure measured by pressure sensor 122 reaches a predetermined value.

Block 306 performs an initial constant-pressure phase, during which the temperature in the vacuum chamber 102 increases, but the pressure is kept roughly constant. The details of the constant-pressure phases and the constant-temperature phases will be described in greater detail below. This phase continues until block 308 determines that the temperature of the tray $T_{tray}$ meets or exceeds a maximum temperature $T_u$, or until block 310 determines that the time of the phase $t_0$ exceeds a maximum initial constant pressure phase time $t_{icp}$.

If block 310 finds that $t_{icp}$ has been exceeded, block 312 begins a new constant-pressure phase, with new parameters, including the pressure at the beginning of the phase $P_0$ and the maximum tray temperature $T_u$. During this phase, the temperature increases in the vacuum chamber 102 increases, while the pressure is kept roughly constant. The new constant-pressure phase continues until block 314 determines that the tray temperature $T_{tray}$ has exceeded the maximum tray temperature $T_u$, or until block 315 determines that the temperature has increased by an amount $T_{thld}$ from the temperature at the start of the phase $T_0$.

If block 315 finds that the temperature has increased by at least the threshold amount $T_{thld}$, block 316 beings a new constant-temperature phase, with parameters that include the target pressure from the previous phase $P_0$, and the temperature at the start of the phase, $T_1$. During this phase, the pressure in the vacuum chamber 102 increases, while the temperature is kept roughly constant. The new constant-temperature phase continues until block 318 determines that the tray temperature $T_{tray}$ has exceeded the maximum tray temperature $T_u$, or until block 320 determines that the pressure has decreased by an mount $P_{thld}$ from the pressure at the start of the phase $P_1$.

In some embodiments, $T_{thld}$ may be between about 2° C. and about 5° C. For $P_{thld}$, the actual pressure measurements and threshold values may be handled as voltages, relating to the output voltage of the pressure sensor 122, rather than handling the values in units of pressure. For example, a difference of 0.5V in the pressure sensor reading may correspond to an exemplary 500 microns of actual pressure. To keep the system at 500 microns, the target pressure measurement voltage value may be set to, e.g., 0.568V. The voltage reading may be non-linear with the actual pressure. Thus, 0.5V, 0.4V, and 0.3V may correspond to 500 microns, 1500 microns, and 4500 microns, respectively. Thus, while $P_{thld}$ may be a constant in voltage-space, for example ranging from 0.0125V to about 0.125V, this number may not correspond to a consistent pressure value. A particularly contemplated voltage value for $P_{thld}$ is 0.0375V, but it should be understood that other values are also contemplated.

If block 320 finds that the pressure has decreased by at least the threshold amount $P_{thld}$, processing returns to block 312 for another new constant-pressure phase, with updated parameters. The constant-pressure phases and constant-temperature phases alternate, until one of block 314 or block 318 breaks the cycle.

If any of blocks 308, 314, or 318 determines that $T_{tray}$ has exceeded the maximum tray temperature $T_u$, then a final drying phase 322 begins, with parameters that include target vacuum pressure $P_{tg}$ and the maximum tray temperature $T_u$. The final drying phase 322 continues until a predetermined condition is reached. In some embodiments, the condition may include a sensed vacuum pressure that is below a threshold value, for example below a threshold that may be in a range between about 110 microns and about 150 microns, with a specifically contemplated example being 130 microns. Once the condition has been reached, the freeze drying process is complete. The pressure valve 108 may be opened to normalize pressure inside the vacuum chamber 102, and the freeze-dried samples 118 may be removed.

Figure 4:
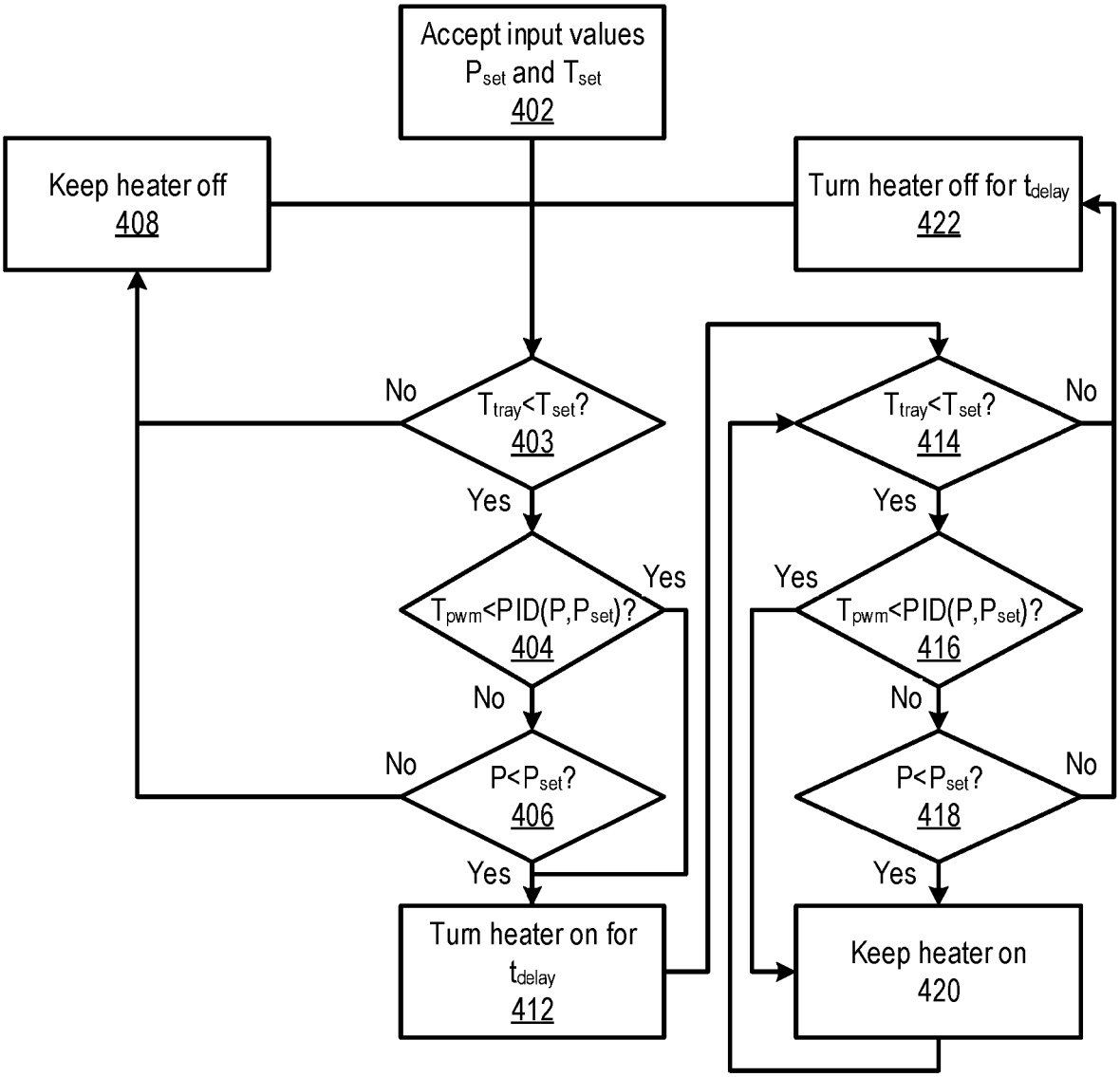
FIG. 4 is a block/flow diagram of a method for controlling the heater in a freeze-drying system during either a constant-pressure drying phase or a constant-temperature drying phase, in accordance with an embodiment of the present principles.

Referring now to FIG. 4, a process is shown for performing a constant-pressure or constant-temperature phase, as described above in blocks 206, 212, 216, 306, 312, and 316. Block 402 initializes input variables $P_{set}$ and $T_{set}$. Thus, for example, when block 206 begins the initial constant-pressure phase, using parameters $P_{tg}$ and $T_u$, block 402 sets $P_{set}=P_{tg}$, and $T_{set}=T_u$. Notably, the same logic is used to control both the constant-pressure and constant-temperature phases of operation.

During sublimation, the temperature of the sample 118 will tend to increase, while the temperature of the tray 116 will drop from heat transfer to the cold interior surface of the vacuum chamber 102. Block 403 determines whether the tray temperature $T_{tray}$ is below the input temperature $T_{set}$. If the temperature is above the input temperature, then block 408 keeps the heating of the tray 116 off, and processing returns to block 403.

If $T_{tray}$ is below $T_{set}$, then block 404 determines whether a repeating timer $t_{pwm}$ is less than the output of a proportional-integral-derivative (PID) controller, which takes the current pressure P and the input pressure $P_{set}$ as inputs. A PID controller provides a control loop that calculates an error value, as the difference between the measured P and the set point $P_{set}$, outputs a correction value, and applies a correction based on proportional, integral, and derivative terms. The PID controller attempts to minimize the difference between P and $P_{set}$ by adjusting a proportion of the time that the heater 116 is turned on. In some embodiments, the PID may continuously output a number between, for example, 0 and 90, with a repeating timer $t_{pwm}$ running between 0 and 90 seconds. When the number of seconds on the $t_{pwm}$ timer is smaller than the PID output, the heater 116 may be turned on. If the number of seconds on the $t_{pwm}$ timer equals or exceeds the PID output, the heater 116 may be turned off.

Thus, block 406 determines whether the pressure P is less than $P_{set}$. If both blocks 404 and 406 indicate a negative output, then block 408 keeps the heater turned off. If either of blocks 404 and 406 indicates a positive output, then block 412 turns on the heater for a predetermined period of time $t_{delay}$, for example about 10 seconds, with an exemplary range for $t_{delay}$ being between about 10 s and about 20 s.

Processing then turns to block 414, which determines again whether the tray temperature $T_{tray}$ is lower than the input temperature $T_{set}$. If not, block 422 turns the heater off for a period of Time $t_{delay}$. It should be noted that it is specifically contemplated that the time delays of blocks 412 and 422 may be the same, as shown, but these time periods may also differ as appropriate.

If $T_{tray}$ is not less than $T_{set}$, then blocks 416 and 418 make determinations similar to those of blocks 404 and 406. If either block outputs a positive result, then block 420 keeps the heater on and processing returns to block 414. If both blocks output a negative result, then block 422 turns the heater off for the time period $t_{delay}$, and processing returns to block 403.

The input pressure $P_{set}$ and temperature $T_{set}$ will determine the behavior of this process, keeping the system in either a constant-pressure or constant-temperature state. The loop continues until an externally determined condition is reached, such as those shown in blocks As sublimation occurs, an object undergoing sublimation will tend to increase in temperature over time, as the sublimation surface decreases through the loss of water to a vaporous state. As the sublimation surface decreases, so too does the rate of sublimation, and thus the rate of heat loss to sublimation also drops, leading to heat buildup within the sample. At the same time, the lower rate of sublimation leads to less water vapor being released into the vapor chamber 102, resulting in a lower pressure in the vapor chamber 102.

The present embodiments therefore make use of the heater to balance between these two processes. Turning the heater on infrequently will allow the temperature of the tray to stay constant, while the pressure in the vacuum chamber decreases. Turning on the heater more frequently will promote faster sublimation, causing additional water vapor to be released, thus making it possible to keep the pressure constant, while the temperature rises.

The sublimation rate is driven by the temperature difference between the sample 118 and the heating tray 116. When the tray temperature is kept constant, for example during a constant-temperature phase, the sublimation rate tends to decrease. This occurs because the sample sublimation surface decreases over time and because the temperature difference, which drives heat transfer and thus sublimation rate, goes down as the sample temperature increases. The lower sublimation rate leads to a lower system pressure. With more frequent heating, the tray temperature rises and heat transfer to the sample increases, thereby increasing the sublimation rate, which makes it possible to keep the system at a constant pressure.

Figure 5:
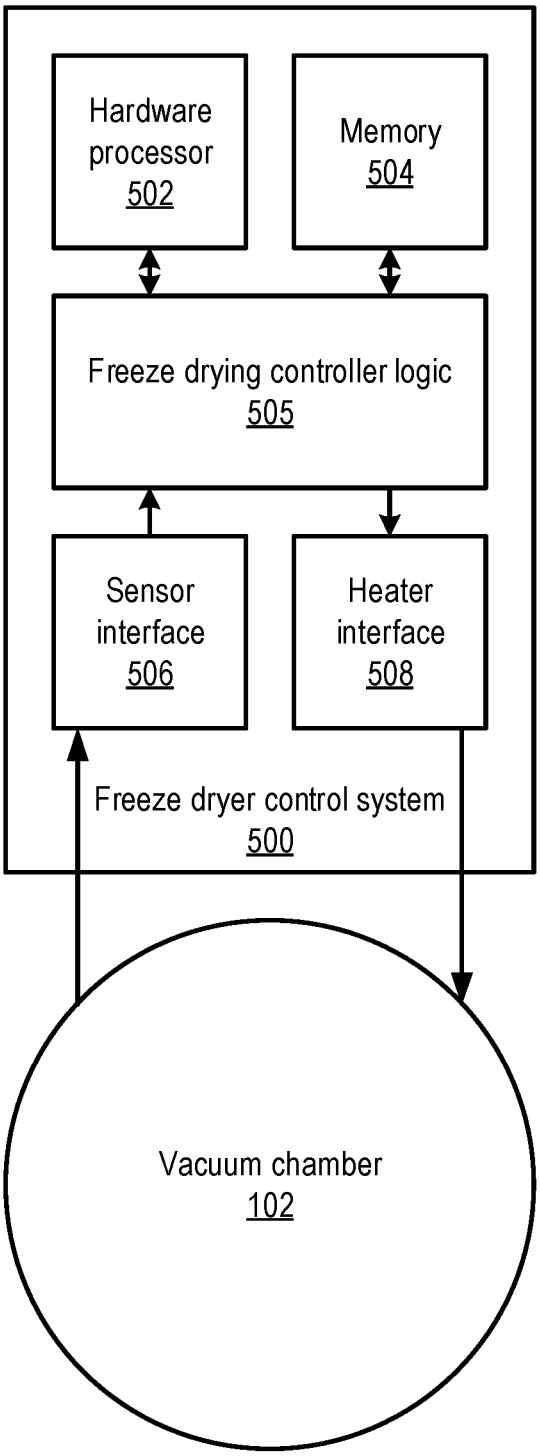
FIG. 5 is a block diagram of a freeze dryer control system that is configured to control a heating tray within a vacuum chamber to perform a freeze-drying process, in accordance with an embodiment of the present principles.

Referring now to FIG. 5, a freeze dryer control system 500 is shown, interfacing with a vacuum chamber 102 and associated apparatuses. The control system 500 may include a hardware processor 502 and a memory 504. Freeze drying controller logic 505 receives sensor information from temperature sensor 120 and pressure sensor 122 via a sensor interface 506. Based on the received sensor information, the freeze drying controller logic 505 sends instructions to a heater interface 508 to control the heating trays 116, for example using the logic described above. In some embodiments, the heater interface 508 may be implemented as a set of relays. The set of relays may receive signals from the controller logic 505 to turn the heating trays 116 on and off. The set of relays may further be used to control the operation of the condenser 110, the vacuum pump 104, and the valves.

It should be understood that the freeze drying controller logic 505 may, in some embodiments, be implemented as software that is stored in the memory 504 and that is executed by the hardware processor 502. In other embodiments, the freeze drying controller logic 505 may be implemented in the form of discrete hardware components, for example as an application-specific integrated chip or field programmable gate array.

The sensor interface 506 can communicate with the sensors by any appropriate wired or wireless medium and protocol. In some embodiments, the sensor interface 506 may receive sensor values directly as, e.g., voltages output by the respective sensors, and may convert these voltages to meaningful units. In other embodiments, the sensor interface 506 may receive pre-processed sensor values from the respective sensors, communicated via a network interface. The heater interface 508 may provide a voltage to heating elements in the heating trays 116. In other embodiments, the heater interface 508 may provide instructions to a separate heating component that, in turn, controls a voltage to the heating trays 116.

As noted above, the freeze dryer control system 500 may be integrated with the vacuum chamber 102, or may be positioned within the vacuum chamber 102, or may alternatively be positioned outside the vacuum chamber 102 in any appropriate housing, with appropriate communication leads between the system 500 and the components within the vacuum chamber 102.

Embodiments may include a computer program product accessible from a computer-usable or computer-readable medium providing program code for use by or in connection with a computer or any instruction execution system. A computer-usable or computer readable medium may include any apparatus that stores, communicates, propagates, or transports the program for use by or in connection with the instruction execution system, apparatus, or device. The medium can be magnetic, optical, electronic, electromagnetic, infrared, or semiconductor system (or apparatus or device) or a propagation medium. The medium may include a computer-readable storage medium such as a semiconductor or solid state memory, magnetic tape, a removable computer diskette, a random access memory (RAM), a read-only memory (ROM), a rigid magnetic disk and an optical disk, etc.

Each computer program may be tangibly stored in a machine-readable storage media or device (e.g., program memory or magnetic disk) readable by a general or special purpose programmable computer, for configuring and controlling operation of a computer when the storage media or device is read by the computer to perform the procedures described herein. The present embodiments may also be considered to be embodied in a computer-readable storage medium, configured with a computer program, where the storage medium so configured causes a computer to operate in a specific and predefined manner to perform the functions described herein.

A data processing system suitable for storing and/or executing program code may include at least one processor coupled directly or indirectly to memory elements through a system bus. The memory elements can include local memory employed during actual execution of the program code, bulk storage, and cache memories which provide temporary storage of at least some program code to reduce the number of times code is retrieved from bulk storage during execution. Input/output or I/O devices (including but not limited to keyboards, displays, pointing devices, etc.) may be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

As employed herein, the term "hardware processor subsystem" or "hardware processor" can refer to a processor, memory, software, or combinations thereof that cooperate to perform one or more specific tasks. In useful embodiments, the hardware processor subsystem can include one or more data processing elements (e.g., logic circuits, processing circuits, instruction execution devices, etc.). The one or more data processing elements can be included in a central processing unit, a graphics processing unit, and/or a separate processor- or computing element-based controller (e.g., logic gates, etc.). The hardware processor subsystem can include one or more on-board memories (e.g., caches, dedicated memory arrays, read only memory, etc.). In some embodiments, the hardware processor subsystem can include one or more memories that can be on or off board or that can be dedicated for use by the hardware processor subsystem (e.g., ROM, RAM, basic input/output system (BIOS), etc.).

In some embodiments, the hardware processor subsystem can include and execute one or more software elements. The one or more software elements can include an operating system and/or one or more applications and/or specific code to achieve a specified result.

In other embodiments, the hardware processor subsystem can include dedicated, specialized circuitry that performs one or more electronic processing functions to achieve a specified result. Such circuitry can include one or more application-specific integrated circuits (ASICs), field-programmable gate arrays (FPGAs), and/or programmable logic arrays (PLAs).

These and other variations of a hardware processor subsystem are also contemplated in accordance with embodiments of the present invention.

Figure 6:
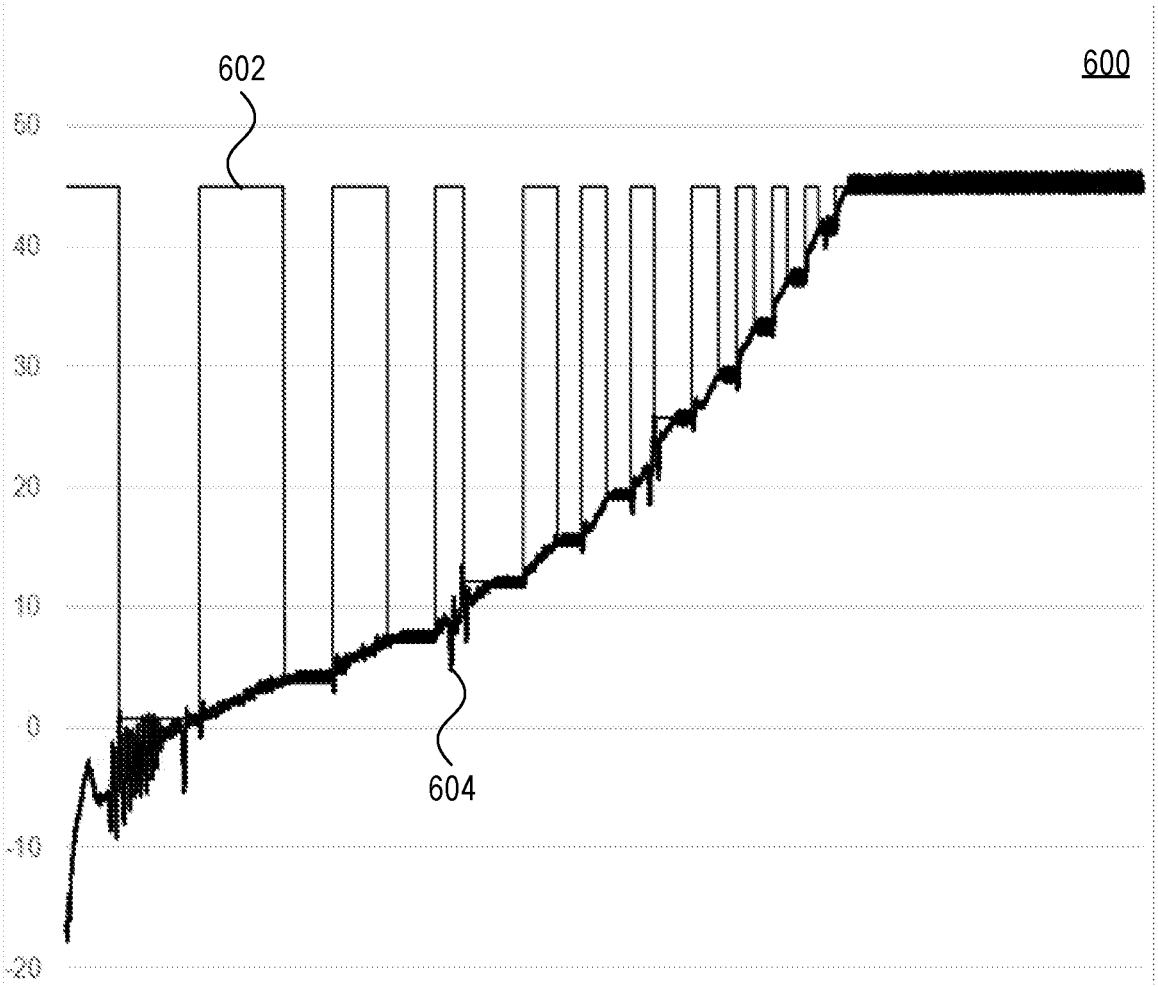
FIG. 6 is a graph that illustrates exemplary temperature curves of a freeze-drying process, in accordance with an embodiment of the present principles.

Referring now to FIG. 6, a graph 600 with an exemplary temperature curve is shown for a freeze drying process. The vertical axis shows temperature, in units of Celsius, and the horizontal axis marks time, with increasing time going from left to right. The set temperature 602 at various phases is shown, as is the measured temperature 604. During constant-pressure phases, the set temperature 602 is relatively high, for example being set to the maximum temperature value, allowing the measured temperature 604 to rise. During constant-temperature phases, the set temperature 602 is set at a recently measured temperature value, and the temperature is kept relatively constant during those time periods. Eventually, the maximum temperature is reached, and the temperature is maintained at a constant temperature value until the drying process is complete.

Figure 7:
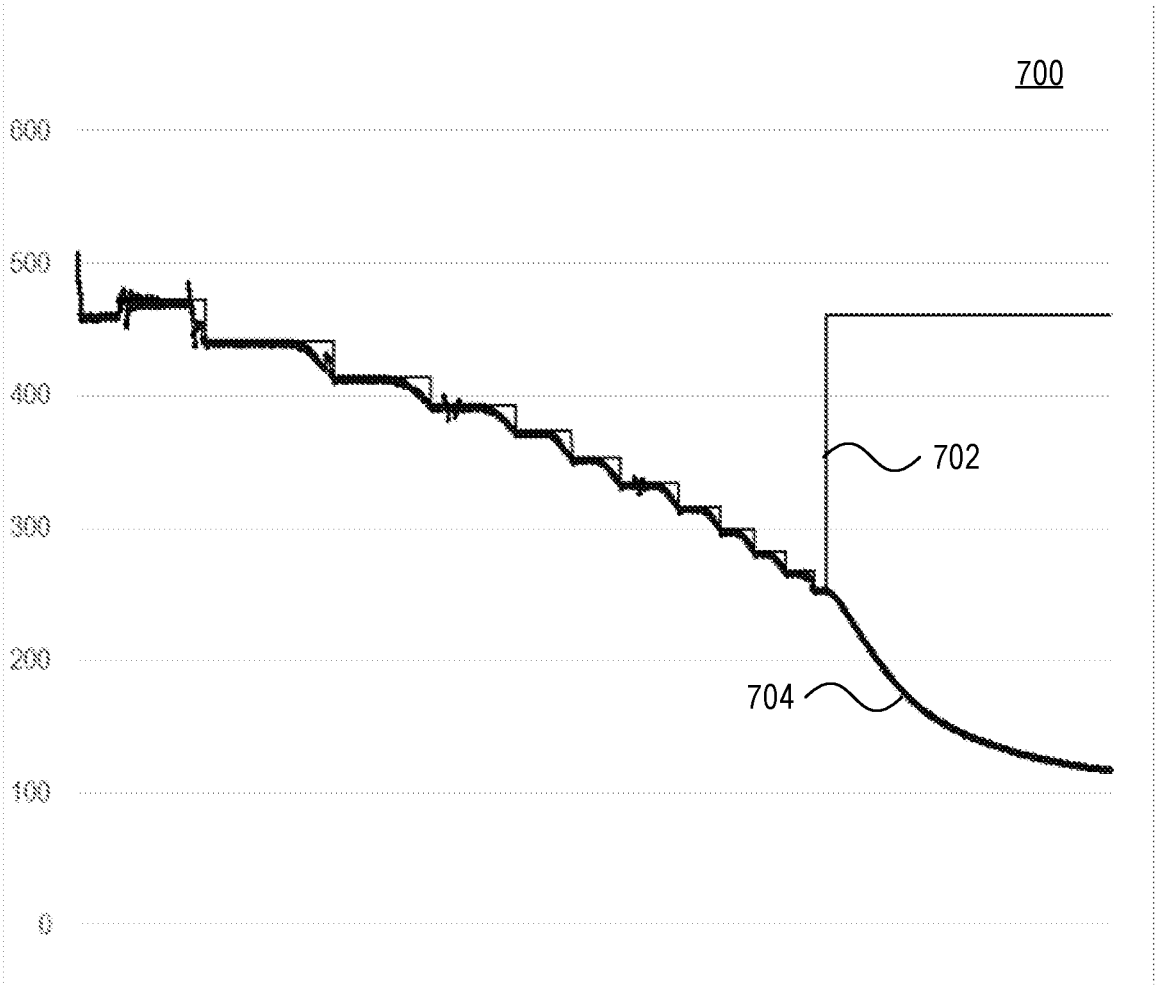
FIG. 7 is a graph that illustrates exemplary pressure curves of a freeze-drying process, in accordance with an embodiment of the present invention.

Referring now to FIG. 7, a graph 700 with an exemplary pressure curve is shown for a freeze drying process. The vertical axis shows pressure, in units of microns, and the horizontal axis marks time, with increasing time going from left to right. The set pressure 702 at various phases is shown, as is the measured temperature 704. The set temperature 702 stays the same for a pair of constant-pressure and constant-temperature phases. During the constant-pressure phase, the measured pressure 704 is held at the target value. During the subsequent constant-temperature phase, the measured pressure 704 drops. At the end of the constant-temperature phase, the measured pressure value is used as the next set pressure value for the next constant-pressure phase.

The foregoing is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that those skilled in the art may implement various modifications without departing from the scope and spirit of the invention. Those skilled in the art could implement various other feature combinations without departing from the scope and spirit of the invention.

The invention claimed is:

1. A method, comprising:

performing a constant-pressure drying phase in a chamber, where a temperature of a heating tray increases, including activating a heater that causes a sample sublimation rate to match a combined evacuation rate and condensation rate;

performing a constant-temperature drying phase in the chamber, where a pressure in the chamber decreases;

alternating between additional constant-pressure drying phases and additional constant- temperature drying phases; and halting the alternating drying phases responsive to a determination that the temperature of the heating tray has reached a maximum temperature.

2. The method of claim 1, further comprising measuring the temperature of the heating tray using a temperature sensor.

3. The method of claim 1, wherein alternating between constant-pressure drying phases and constant-temperature drying phases is triggered in a fixed-period mode.

4. The method of claim 1, wherein alternating between constant-pressure drying phases and constant-temperature drying phases is triggered in a threshold-triggered mode.

5. The method of claim 1, wherein performing the constant-temperature drying phase comprises activating a heater that compensates for heat loss due to sample sublimation.

6. The method of claim 1, further comprising performing an initial constant-pressure phase, before the constant-pressure drying phase.

7. The method of claim 1, further comprising measuring a pressure in the chamber using a pressure sensor.

8. The method of claim 7, further comprising performing a final phase, after halting the drying phases, at the maximum temperature, where pressure in the chamber decreases to a terminal value.

9. A system, comprising:

a vacuum chamber;

a vacuum pump, configured to evacuate the vacuum chamber;

a heating tray positioned within the vacuum chamber; and a controller, configured to control the heating tray to perform a constant-pressure drying phase in a chamber, where a temperature of the heating tray increases, to perform a constant-temperature drying phase in the chamber, where a pressure in the chamber decreases, to alternate between additional constant-pressure drying phases and additional constant-temperature drying phases, and to halt the alternating drying phases responsive to a determination that the temperature of the heating tray has reached a maximum temperature.

10. The system of claim 9, further comprising a temperature sensor configured to measure a temperature of the heating tray.

11. The system of claim 9, wherein the controller is configured to alternate between constant-pressure drying phases and constant-temperature drying phases in a fixed-period mode.

12. The system of claim 9, wherein the controller is configured to alternate between constant-pressure drying phases and constant-temperature drying phases in a threshold-triggered mode.

13. The system of claim 9, wherein the controller is configured to, during the constant-pressure drying phase, activate the heating tray to cause a sample sublimation rate to match a combined evacuation rate and condensation rate.

14. The system of claim 9, wherein the controller is configured to, during the constant-temperature drying phase, activate the heating tray to compensate for heat loss due to sample sublimation.

15. The system of claim 9, wherein the controller is further configured to perform an initial constant-pressure phase, before the constant-pressure drying phase.

16. The system of claim 9, further comprising a pressure sensor configured to measure a pressure in the vacuum chamber.

17. The system of claim 16, wherein the controller is further configured to perform a final phase, after halting the drying phases, at the maximum temperature, where pressure in the vacuum chamber decreases to a terminal value.

18. The system of claim 17, wherein each subsequent constant-pressure phase has a lower pressure setpoint than each previous constant-pressure phase.

19. A system, comprising:

a vacuum chamber;

a vacuum pump, configured to evacuate the vacuum chamber;

a heating tray positioned within the vacuum chamber;

a temperature sensor, configured to measure a temperature of the heating tray;

a pressure sensor, configured to measure a pressure of the vacuum chamber;

a controller, configured to control the heating tray to perform a constant-pressure drying phase in a chamber, where the temperature of the heating tray increases, by activating the heating tray to cause a sample sublimation rate to match a combined evacuation rate and condensation rate, to perform a constant-temperature drying phase in the chamber, where pressure in the chamber decreases, by activating the heating tray to compensate for heat loss due to sample sublimation, to alternate between additional constant-pressure drying phases and additional constant-temperature drying phases, to halt the drying phases responsive to a determination that a maximum temperature has been reached, and to perform a final phase, after halting the drying phase, where pressure in the vacuum chamber decreases to a terminal value.

* * * * *